United States Patent [19]

Berry et al.

[11] Patent Number: 4,494,343

[45] Date of Patent: Jan. 22, 1985

[54] STRUCTURE FOR RETROFITTING CORRUGATED BUILDING EXTERIORS

[75] Inventors: James A. Berry; Morton Sherman, both of St. Petersburg, Fla.

[73] Assignee: The Celotex Corporation, Tampa, Fla.

[21] Appl. No.: 345,899

[22] Filed: Feb. 4, 1982

Related U.S. Application Data

[63] Continuation of Ser. No. 126,517, Mar. 3, 1980, abandoned.

[51] Int. Cl.[3] ..... E04C 2/26; E04C 2/32

[52] U.S. Cl. ..... 52/309.11; 52/410; 52/478; 52/748

[58] Field of Search ..... 52/410, 478, 309.11, 52/309.9, 309.8, 404, 747, 748

[56] References Cited

U.S. PATENT DOCUMENTS

| | | | |
|---|---|---|---|
| 3,377,760 | 4/1968 | Waite | 52/410 |
| 3,474,583 | 10/1969 | Manias | 52/302 |
| 3,482,367 | 12/1983 | Curran | 52/478 |
| 3,513,614 | 5/1970 | Studzinski | 52/743 |
| 3,662,509 | 5/1972 | Studzinski | 52/404 |
| 3,909,998 | 10/1975 | Simpson et al. | 52/223 |
| 4,021,982 | 5/1977 | Kotcharian | 52/410 |
| 4,081,938 | 4/1978 | Bertacchi et al. | 52/410 |

FOREIGN PATENT DOCUMENTS

| | | | |
|---|---|---|---|
| 875213 | 8/1961 | United Kingdom | 52/478 |

OTHER PUBLICATIONS

"Building on Tradition," *Insulation*, pp. 5-6, Feb. 1979.

"Cathedral Condensation Eliminated," *Insulation*, p. 8, Mar. 1979.

*Primary Examiner*—John E. Murtagh

*Attorney, Agent, or Firm*—James W. Grace; Charles W. Vanecek

[57] ABSTRACT

A building structure comprising a corrugated protective layer having crests and valleys, a plurality of rigid metal securement strips applied over the corrugated protective layer, an outer weather-resistant covering applied over the rigid metal securement strips, and connecting means for securing said building elements together. A layer of insulation may be included between the rigid metal securement strips and exterior weather-resistant covering. The outer weather-resistant covering, the layer of insulation, and the metal securement strips can be secured to the corrugated protective layer without disturbing the preexisting structure.

9 Claims, 5 Drawing Figures

FIG. 1
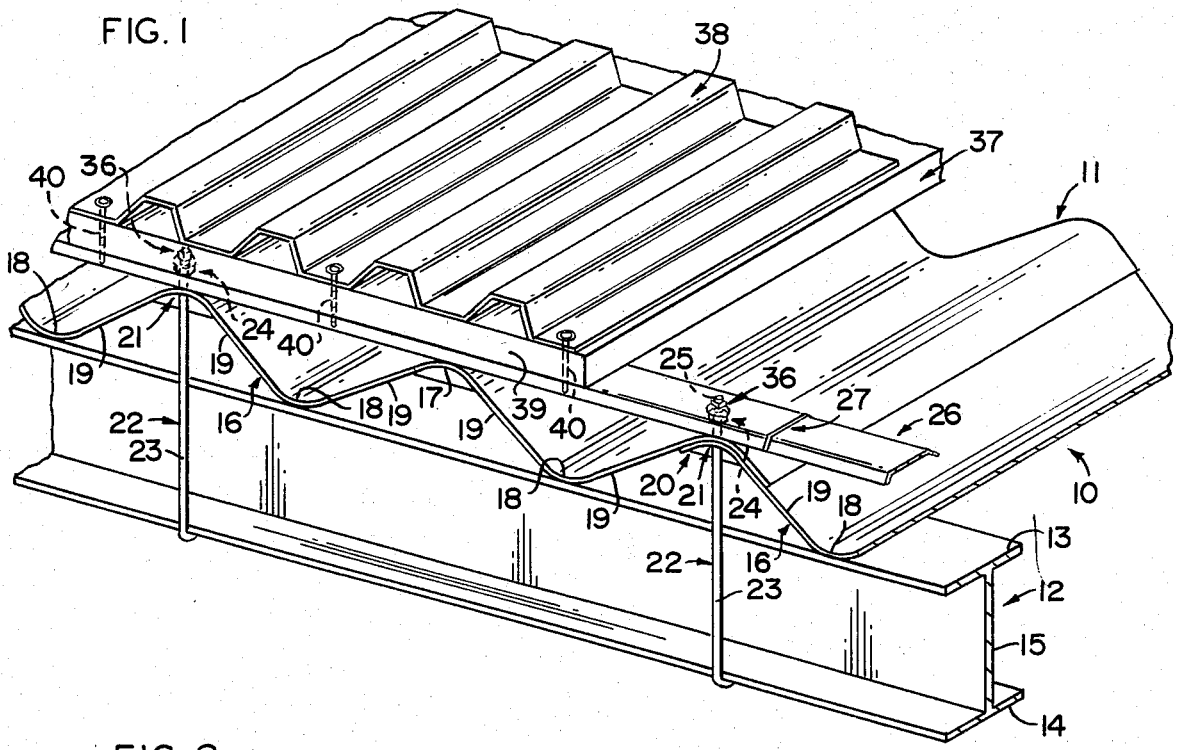
FIG. 2
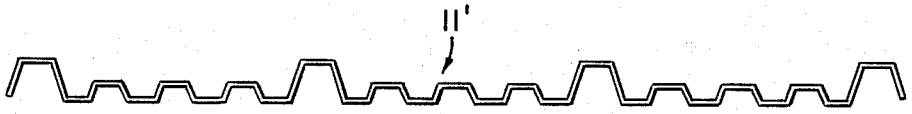
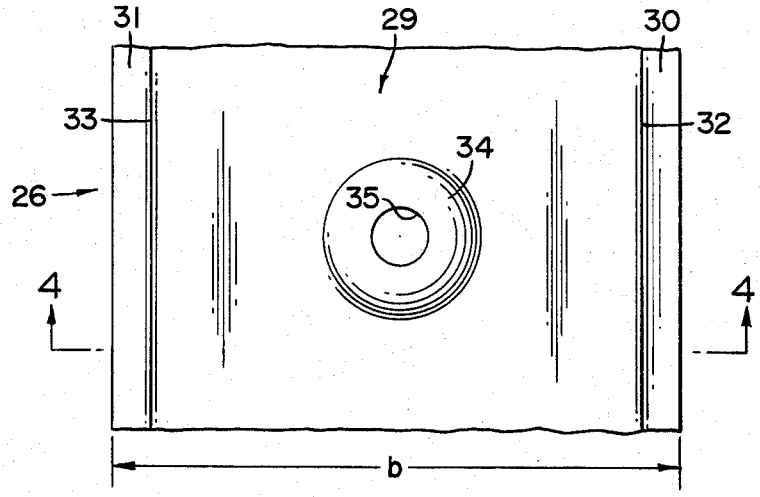
FIG. 3
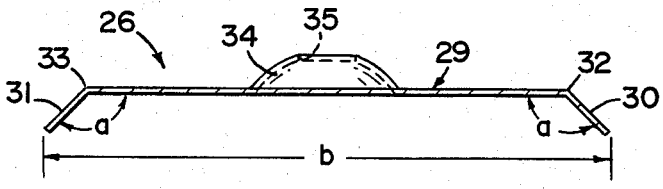
FIG. 4
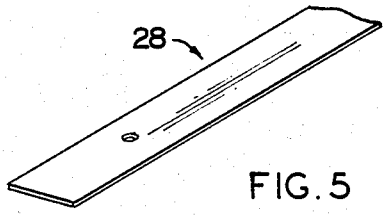
FIG. 5

STRUCTURE FOR RETROFITTING CORRUGATED BUILDING EXTERIORS

This is a continuation of application Ser. No. 126,517, filed Mar. 3, 1980, now abandoned.

BACKGROUND OF THE INVENTION

1. Field of the Invention

This invention is directed to a structure for retrofitting corrugated building exteriors by using metal securement strips in the building structure, especially as a securement system between the existing corrugated roof and/or wall sheets and an exterior, retrofitting layer of insulation board and outer weather-resistant covering combination.

2. Description of the Prior Art

There is a need to better thermally insulate the exterior roof and wall structures of existing buildings (retrofit) in these times of diminishing and ever more costly energy resources. The escalation of energy costs in recent years has been accompanied by increased concern on the part of home owners, the owners of commercial buildings, builders and utility companies for economical, high efficiency thermal insulation systems.

The task of insulating existing buildings (retrofitting) is often complicated because of the design and/or composition of the particular structures already in place in these buildings. Where the exterior surface of the building is in the shape of corrugations or regularly or irregularly spaced configurations of equal or dissimilar height or the like, it is difficult and costly to properly and securely attach a retrofitted building structure to the surface. Furthermore, whatever attachment method is employed should not adversely affect the insulating efficiency of the retrofitted structure. In addition, it is advantageous if the preexisting building structure can be utilized without any basic changes to that structure.

Timber battens have heretofore been used as fastening means in building structures, as, e.g., on flat concrete roofs. Unfortunately, there are various drawbacks in the use of this type of fastening system, among which may be mentioned its combustibility, susceptibility to drying out, warping and cracking, less than desirable strength-to-weight ratio and dimensional stability, and undesirably thick cross-sectional profile.

Presently, there are literally thousands of buildings whose roofs are in need of repair. The existing roofs, having seen years of service and weathering, are deteriorating and rusting out, are under-insulated, and are subject to leaks, etc. These buildings with roll formed metal or corrugated cement asbestos roofs enclose millions of square feet of uninsulated space. It would be highly desirable if a strong, lightweight, incombustible, simple, easily installed and economical to utilize fixing structure could be found for the application of an insulation layer and cover sheet assembly to these difficult-to-insulate corrugated structures.

OBJECTS OF THE INVENTION

It is therefore an object of the present invention to provide an improved insulated building structure, which is designed for application to the exterior side of an existing corrugated-like building structure, particularly to a corrugated-like roof structure.

It is another object of the present invention to provide an insulated building structure with a low over-all heat-transfer coefficient.

A further object of the invention is to provide novel rigid metal strips for securely attaching a retrofitting structure to the exterior of a corrugated-like building structure without basically altering the preexisting building structure.

Other objects and advantages of the present invention will become apparent to those skilled in the art when the instant disclosure is read in conjunction with the accompanying drawings in which like numerals indicate like elements.

SUMMARY OF THE INVENTION

This invention system is designed for installation on the exterior side of an existing building structure which has a corrugated-like shape. The invention involves the installation of a plurality of elongated metal strips onto any building structure whose exterior has a corrugated-like profile. The rigid metal strips are applied so as to span the surface profile of the existing building structure from edge to edge in a grid-like manner, the strips being positioned on and lying transverse to the crests of said exterior. An insulation layer can be applied over the network of rigid metal strips to provide a complete insulating envelope over the existing building structure. Exterior sheathing can be applied over the insulation to form a weatherproof barrier.

The assembly of rigid metal securement strips of the invention provides a unique interface between existing and new building structures, and functions as both an attachment means and a support for the application of the new retrofitted structure to the existing one. The interface securement system of the invention can be utilized for the external retrofit of an insulation board and covering assembly to the corrugated exteriors of both roofs and walls. The securement system is especially suited for the retrofit of existing buildings with corrugated cement asbestos roofs and walls, where the existing panel hook bolts can be used for securing the system, without the need for any loosening or removal of the hook bolts.

DESCRIPTION OF THE DRAWINGS

In the drawings:

FIG. 1 is a fragmentary perspective view of a roof structure illustrating the application of this invention, with portions broken away to show the internal construction of the structure including the existing roof sheet, metal securement strips, insulation layer and weatherproof barrier;

FIG. 2 is a cross-sectional profile of another existing roof sheet which can be retrofitted in accordance with this invention;

FIG. 3 is an enlarged fragmentary top view of the metal securement strip of FIG. 1, showing the dimple for accommodating the washer and nut of the existing roof bolt;

FIG. 4 is a cross-sectional view taken on line 4—4 of FIG. 3; and

FIG. 5 is an enlarged fragmentary perspective view of a metal securement strip constructed in accordance with another embodiment of the invention.

DETAILED DESCRIPTION OF THE INVENTION

This invention will be described as embodied in a retrofitted roof structure constructed with the arrangement of the parts as illustrated in FIG. 1. The attachment and insulation systems of the invention are especially useful in retrofitting existing corrugated roofs of commercial buildings. It is to be understood, however, that the dimensions, arrangement and assembly of the parts shown in this typical construction could be changed in various ways, and the concept of the invention would still be effective in providing for the secure attachment of an exterior structure, especially an insulating one, to a corrugated-like building structure configurated with crests and valleys.

Referring now in particular to FIG. 1, there is illustrated an existing roof structure 10 comprising, in general, a roof sheet 11 secured to a supporting skeletal framework, which is provided by a plurality of spaced, longitudinally extending purlins 12 (only one shown in FIG. 1). By way of example, the roof of a commercial building might have 23 such purlins. The purlins are conventionally mounted on underlying rafters in a parallel spaced relation. Each purlin 12 preferably has an approximately I-shaped cross-sectional configuration formed by a longitudinally extending upper flange 13 connected to a lower flange 14 by a central web portion 15, the upper and lower flanges extending perpendicularly to web 15. The configuration of purlin 12 can be formed such that relatively thin light material can be used to fabricate the purlin which yet retains sufficient strength to form adequate support in the roof structure.

The roof sheet 11 comprises a cement asbestos composite, a suitably protected metal sheeting, such as painted galvanized steel, painted aluminum alloys, asphalt-asbestos coated galvanized steel, etc. or any other conventional existing roof structure and usually consists of a plurality of individual sections 16. Sections 16 have a generally corrugated profile, which is characterized by crests 17 and valleys 18 connected by inclined side walls 19 (See FIG. 1). The crested profile of the existing roof sheet to be retrofitted in accordance with the invention can have a virtually unlimited number of configurations, both sinusoidal and non-sinusoidal. Any existing roof surface which has crests capable of being spanned can be retrofitted. The cross-sectional profile of another such existing roof sheet 11' configurated with crests and valleys is illustrated in FIG. 2. Sections 16 are adapted to span over the upper surfaces of adjacent purlins 12. This roof sheet arrangement, however, may vary with the specific building site being retrofitted. The individual sections 16 are contiguously aligned in an overlapping side-by-side and end-to-end arrangement to form the existing roof sheet 11, and are secured together to purlins 12, with 4 sections overlapping in the roof field and 2 sections overlapping at the roof perimeter. For purpose of illustration in the cutoff view of FIG. 1, only a perimeter roof overlap 20 is shown. The attachment can be accomplished by any suitable fastening means, including rivets, nuts and bolts, etc. Each roof section 16 can also be secured to purlin 12 at various intermediate points along its side length, such as at point 21 shown in FIG. 1. Roof sections 16 are advantageously secured to purlins 12 by fasteners placed through their crest portions.

Suitable fasteners 22 for securing the roof section or sections to the purlin are shown in FIG. 1. Fastener 22 comprises a roof bolt 23 clamping the purlin 12 and section(s) 16 together and extending through section(s) 16 with a washer and nut combination 24 securing the section(s) at the upper end of the bolt. As can be seen in FIG. 1, the washer and nut combination 24 is located adjacent the upper surface and at the crest of a given roof sheet section, with the upper end 25 of the bolt projecting a short distance beyond the washer and nut combination. In practice a weatherproof cap or shield is placed over the exposed portion of bolt 23 above washer and nut combination 24 to protect the threads, otherwise exposed to the elements. To this point, a conventional roof structure has been described. The improved structure for retrofitting the existing building exterior will now be described.

Referring now to FIG. 1, each attachment strip 26 comprises an elongated sheet of metal which is secured to the existing roof structure, preferably at points along the upper surface of the roof sheet 11 at the crests thereof. Suitable methods of securement include through fasteners to the existing purlin or girt, welding to the existing roof or wall sheet, etc. Securement strip 26 advantageously comprises a long, narrow, rigid strip of metal which is applied transversely to the crests 17 of roof sheet 11. A number of strips 26 can be placed lengthwise one after the other in an end-to-end abutting or overlapping arrangement to thereby span the entire roof sheet being covered in a continuous manner from one edge of the roof to the other. Rows of strips 26 are spaced from each other to form a spaced grid. One such overlapping point 27 of two aligned strips is shown in FIG. 1.

The sheet metal strip 26 of this invention provides excellent structural characteristics while reducing weight and providing a structural shape which can be readily fabricated from sheet metal. Strips 26 can be fabricated with varying characteristics to meet different requirements of shape, strength, weight, thickness ratio, etc. For example, in roofs the strips must have sufficient lateral strength to support whatever loading is placed thereon and to resist wind loadings that might tend to lift the roof assembly. The securement strips of the invention can have any convenient shape and thickness that accomplish the dual purposes of securing and supporting the retrofitted building assembly to the existing corrugated structure. In some cases the existing configuration may dictate special adaptations of the strips, as illustrated by the dimples utilized in the roof structure of FIGS. 1, 3, and 4. Strip 26 can suitably have a thickness gauge of from about 18 to 12 gauge. In a preferred embodiment, securement strips 26 are fabricated from 16 gauge galvanized metal.

Two embodiments of the securement strip of the invention are illustrated in FIGS. 3–4 and FIG. 5. The embodiment illustrated in FIGS. 3–4 has a central section 29 with downwardly and outwardly extending sidewalls 30 and 31 integrally connected along the longitudinally extending edges 32 and 33, respectively, of the central section, and with apertured dimples 34 spaced along its length. Central section 29 is parallel to the upper surface of purlin flange 13. Sidewalls 30 and 31 are disposed at an acute angle a with reference to the plane of central section 29. Angle a may vary from about 0° to 90°, relative angle to the plane of central section 29. By way of illustration the horizontal distance b (see FIGS. 3 and 4) between the free edges of sidewalls 30 and 31 may be $3\frac{3}{4}$ inches; the height of central section 29 above the horizontal plane perpendicular to crest 17 may be $\frac{3}{8}$ inch; the diameter of dimple 34 at its base may be 1 inch; the height of dimple 34 above central section 29 may be $\frac{1}{4}$ inch; the diameter of hole 35 of the dimple may be $\frac{3}{8}$ inch; and the acute angle a may be a 45° angle.

In the construction shown in FIG. 1, the metal securement strips or plates 26 of the invention are applied to the top surface of the existing roof, the plates being applied directly over and parallel to the existing purlins. The points of attachment of strips 26 to roof sheet 11 are made to coincide with locations of the washer/nut/bolt end or shank 25 assemblies which project above sheet 11. Dimples 34 (see FIGS. 3 and 4) are centrally located along the central section 29 of each strip 26 to accommodate these projecting assemblies. Dimple 34 forms an apertured, convex-shaped cover for the enclosed assembly with central hole 35 through which extends the upper free end portion or shank 25 of bolt 23. It is a simple matter to place strip 26 over the aligned upper ends 25 of exposed bolts 23 after removing the protective cap from each bolt. After the placement of the strip, a washer and nut 36 are placed over the strip 26. In the fully-fastened position, washer and nut 36 are positioned on dimple 34.

FIG. 5 shows an alternative embodiment of the strip of the invention comprising a long, relatively thin strip of metal 28 which is flat and without a dimple at its fastener opening. This strip can be utilized, for example, where there are no projecting assemblies, such as those previously described, above roof sheet 11.

The embodiment of the invention of FIG. 1 illustrates an insulated retrofit of the existing roof structure. In this embodiment, thermal insulating material 37 is secured over the installed securement strips 26. Thermal insulating material 37 can advantageously comprise a rigid foam plastic thermal insulation board which is nailed or otherwise secured as a sheathing to form an insulating layer between old roof 11 and the outside new roof sheet 38, as necessary for weathering requirements not otherwise provided by the exterior of the new thermal insulation layer (see FIG. 1). A foam plastic thermal insulation board, with vapor barrier characteristics, i.e., with a permeance of less than 1 perm and thus capable of interfering with the passage of moisture, is suitable for implementing this invention. The preferred foam plastic thermal insulation board 37 is a product made with a polyurethane or polyisocyanurate foam core with metal sheet facers. These facers may be aluminum adhered to the face of the foam core during the process of manufacture. The aluminum facers can act as heat reflective surfaces and as liquid or gas barriers, since the metal sheets will not permit fluids to penetrate. A suitable foam plastic thermal insulation board is one made by The Celotex Corporation of Tampa, Fla. under the designation Thermax Insulation Board. Typical thermal insulation board dimensions are 4 feet wide × 12 feet long × 1½ inches thick, although boards of different dimensions may just as well be used to implement this invention.

Both rigid and non-rigid insulating layers can be employed in the building structure of the invention. The insulating material can be introduced in the form of loose fill, can be foamed in place, can be nailed, or otherwise installed by any conventional method. Other insulating materials which can be used include surfaced semi-rigid blanket thermal insulation, surfaced rigid cellulosic fiber board, perlite mineral fiber, and foam/-board composites of the above.

The thermal insulating layer of the invention can form part of a composite construction having an insulating core member and an exterior weatherproof covering member. Alternatively, a separate weatherproof exterior covering, such as the roll formed metal roof sheet 38 shown in FIG. 1, can be employed. Exterior sheathing for the roof structure can be provided by any conventional weatherproof barrier used for this purpose.

FIG. 1 illustrates an advantageous method of securing the new insulation sheathing 37 and roof sheet 38 to the retrofitted roof structure in accordance with the present invention. Insulation boards 37 are laid down so that their long edges run parallel to crests 17 of the existing roof sheet, and the edge portions 39 along the width of the boards are perpendicular to said crests, with all butted joints overtaped with 2 inch wide pressure sensitive vapor barrier tape. Where necessary, shanks 25 are shortened to prevent them from projecting above insulation boards 37 when the latter are set in place. Roof sheet 38 is next applied over insulation sheathing 37 and secured in place by suitable fasteners. As seen in FIG. 1, fasteners 40 can be placed so as to lock together sheet 38, sheathing 37 and securement strip 26. At appropriately spaced intervals along each course where the roof sheet 38 and insulation sheathing 37 retrofit composite lies over the corresponding securement strip 26, fasteners 40 are driven through said composite into the underlying securement strip. Other fastening means can, of course, be employed. For example, a single fastener can be driven through the entire retrofitted composite, including the securement strip, and into the existing corrugated roof sheet. In a typical retrofitted roof structure of the invention, a roll formed aluminum roof sheet 38 is applied over insulation board 37 and secured at 8 inches on center laterally (perpendicular to crests 17) and 5½ feet on center longitudinally (parallel to crests 17) to the retrofit securement plates 26 with self-drilling fasteners 40, each having a stainless steel washer, neoprene grommet and plastic cap. Flashing at the roof edges can be installed in a conventional manner. Where required for flashing securement, fasteners can be secured through top sheet 38 and insulation board 37 into the top center of the lapped roof corrugations.

The retrofitting securement strips of the invention provide a highly effective interfacial attachment system for securely linking together dissimilar roof sheets (existing/new). They provide a thin-profiled interface which permits a completely insulating thermal envelope to be installed over an existing roof and/or wall structure. The securement strips are especially effective in providing an interfacial attachment substrate to existing corrugated cement asbestos roof and walls, utilizing existing panel hook bolts of the structure for attachment. No removal or loosening of the hook bolt is required. Furthermore, shorter retrofit fasteners may be used, since they are not required to penetrate through the total old and new composites. Also, the strips furnish a high degree of lateral stiffness to wide pitch existing roofs.

The metal securement strips of the invention fill an urgent need for a low profile substrate to existing exterior roofs and walls of pre-engineered buildings (buildings with roll formed metal panel or corrugated cement asbestos exterior cover sheeting). The substrate provides a lightweight but strong securement ground to receive a retrofit insulation board and retrofit cover sheet through fasteners securing the retrofit composite to the low profile substrate.

Whereas the present invention has been described with respect to specific embodiments thereof, it should be understood that the invention is not limited thereto as many modifications thereof may be made. It is, therefore, contemplated to cover by the present application any and all such modifications as fall within the true spirit and scope of the appended claims.

We claim:

1. A building structure comprising a corrugated-like inner sheath configurated with crests and valleys, the inner sheath being secured to its substructure by first fastening means which extends through and projects exteriorly of the inner sheath, a plurality of rigid, long, thin metal securement strips secured in a spaced arrangement to the inner sheath by attachments to the first fastening means, the metal securement strips being positioned on and lying entirely above and transverse to the crests of the sheath, a layer of insulation board positioned over the metal securement strips, an outer weather-resistant covering positioned over the layer of insulation board, and second fastening means penetrating through and securing together only the outer weather-resistant covering, the layer of insulation board and the metal securement strips.

2. The building structure of claim 1 wherein the inner sheath is a member selected from the group consisting of a cement asbestos roof and a metal sheeting roof, the inner sheath being secured to a plurality of underlying parallel spaced purlins by said first fastening means comprising vertically extending fasteners whose upper ends extend through and project exteriorly of the crests of the inner sheath, and the metal securement strips are secured to the inner sheath by attachments to the upper ends of the fasteners.

3. The building structure of claim 2 wherein the inner sheath is secured to the underlying purlins by said fastener comprising vertically extending bolts whose upper free ends extend through and project exteriorly of the crests of the inner sheath, a washer and nut combination being placed onto each of the bolts and adjacent the crest upper surface to fasten the bolt, each of the metal securement strips has (a) a longitudinally extending central section with downwardly and outwardly extending sidewalls integrally connected along the two longitudinally extending edges of the central section, and (b) apertured dimples centrally located on the strip central section and spaced along its length so as to enclose each of the washer and nut combinations and to permit the bolt upper free end to penetrate through its aperture, and a second washer and nut combination is placed onto each of the bolts and adjacent the dimple upper surface to fasten the bolt.

4. The building structure of claim 3 wherein the longitudinally extending metal securement strips of each roof span comprise a number of strips placed lengthwise one after the other in an end-to-end overlapping arrangement.

5. The building structure of claim 4 wherein the inner sheath comprises a cement asbestos roof.

6. The building structure of claim 4 wherein the outer weather-resistant covering comprises a roll formed aluminum sheet.

7. The building structure of claim 4 wherein the layer of insulation board is a member selected from the group consisting of a foam plastic insulation board, a composite foam/cellulose fiber insulation board, a perlite insulation board, a composite board of perlite and plastic foam, and a rigid wood fiber insulation board.

8. The building structure of claim 4 wherein the layer of insulation board is a member selected from the group consisting of a faced isocyanurate foam plastic insulation board and a faced urethane foam plastic insulation board.

9. A method of installing an exterior structure onto an existing corrugated-like inner sheath which is configurated with crests and valleys and is secured to its substructure by first fastening means which extends through and projects exteriorly of the inner sheath, comprising (a) securing a plurality of rigid, long, thin metal securement strips in a spaced arrangement to the inner sheath by attachments to the first fastening means so that the metal securement strips lie on and are entirely above and transverse to the crests of the sheath, and (b) securing a layer of insulation board over the metal securement strips and an outer weather-resistant covering over the layer of insulation board by second fastening means which penetrates through and fastens together only the outer weather-resistant covering, the layer of insulation board and the metal securement strips.

* * * * *